US005373654A

United States Patent [19]

Whalen

[11] Patent Number: 5,373,654

[45] Date of Patent: Dec. 20, 1994

[54] CORNER PICTURE FRAME

[76] Inventor: James K. Whalen, 3 Public St., N. Attleboro, Mass. 02760

[21] Appl. No.: 138,990

[22] Filed: Oct. 21, 1993

[51] Int. Cl.[5] ..... A47G 1/06

[52] U.S. Cl. ..... 40/152.1; 40/152; 312/245

[58] Field of Search ..... 40/152, 152.1, 646; 312/245, 248

[56] References Cited

U.S. PATENT DOCUMENTS

| | | | |
|---|---|---|---|
| 259,751 | 6/1882 | Downes | 40/152 |
| 873,050 | 12/1907 | Itter | 40/152.1 |
| 1,721,953 | 7/1929 | Hendrickson et al. | 40/152 |
| 1,877,514 | 9/1932 | Katzman | 40/152 |
| 1,916,536 | 7/1933 | Slavin | 40/152 |
| 2,991,577 | 7/1961 | Bellocchio | 40/152.1 |
| 3,694,947 | 10/1972 | Mukai et al. | 40/152 |
| 3,760,521 | 9/1973 | Barraya | 40/152 |
| 3,977,112 | 8/1976 | Breer, II | 40/661 |

*Primary Examiner*—Peter R. Brown
*Assistant Examiner*—Cassandra Davis
*Attorney, Agent, or Firm*—Hugh E. Smith

[57] ABSTRACT

A corner picture frame comprising an enclosed triangular compartment; a recessed hanging member at the apex of the triangular compartment; and a rectangular closure member connecting the sides of said triangular compartment and adapted to support a picture in the outer face thereof. In a preferred embodiment, the rectangular closure member is hinged to swing horizontally providing access to the interior of the triangular compartment. In such instance, at least one triangular shelf is positioned within the compartment to increase the utility of the unit. Also lights may be positioned either top or bottom or both to permit illuminating a translucent picture mounted in the closure member and additional translucent panels may be positioned as closures of the triangular box for decorative purposes.

5 Claims, 4 Drawing Sheets

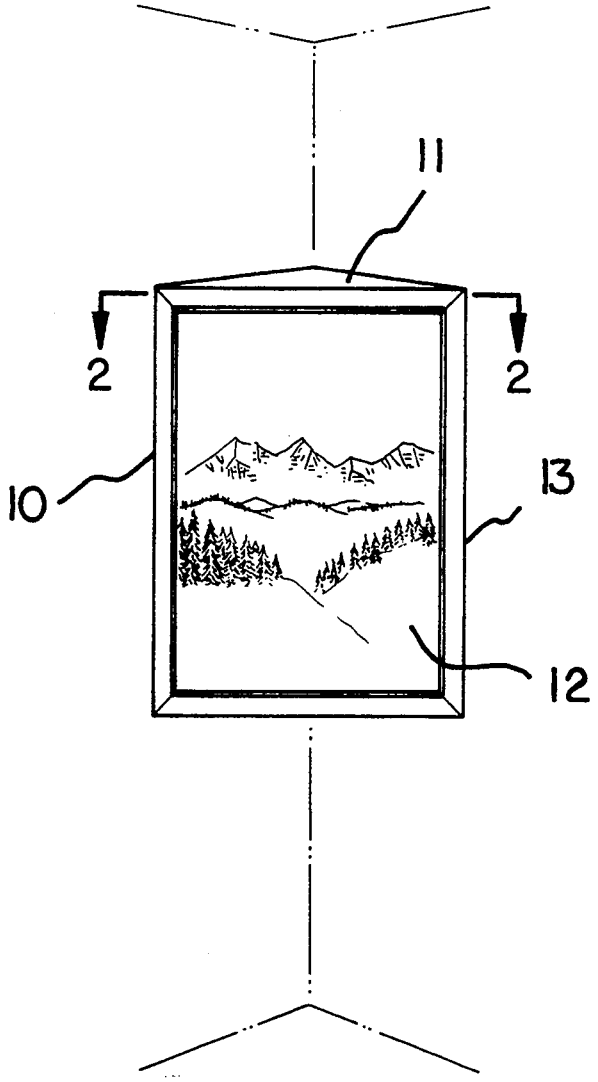
FIG. 1
FIG. 2
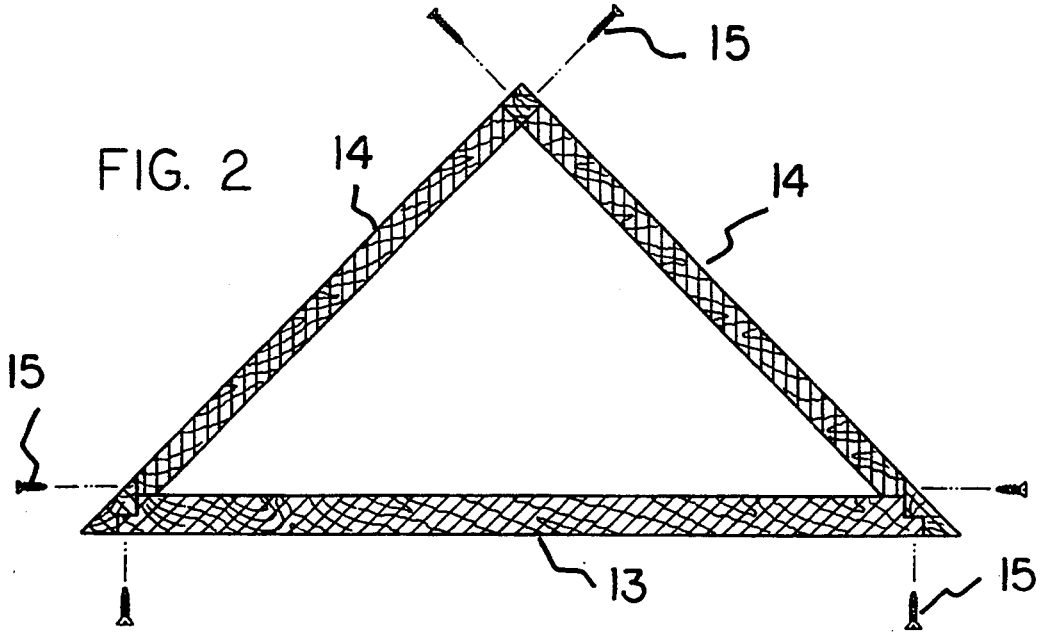

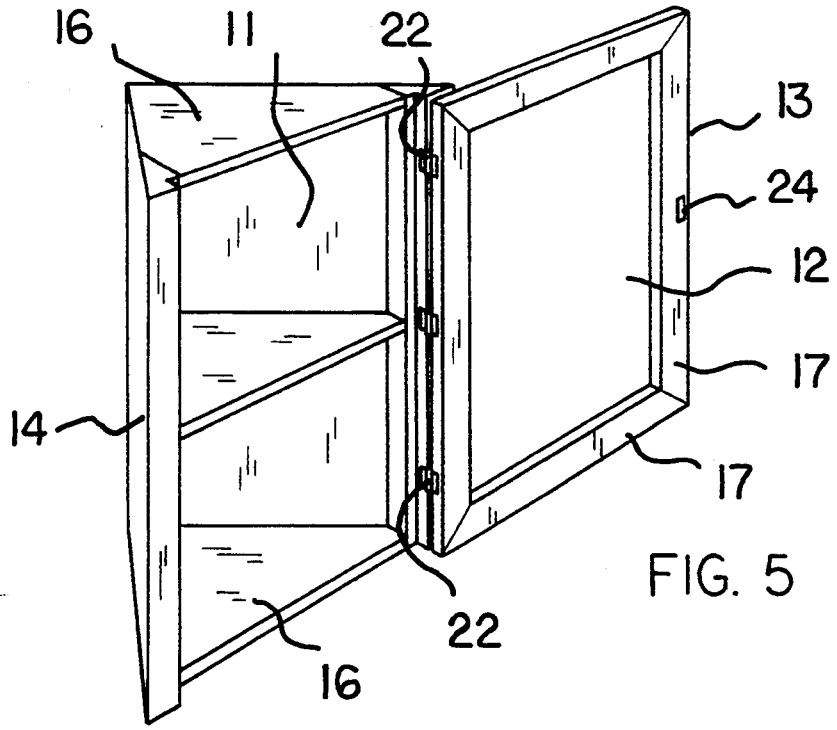
FIG. 5
FIG. 6
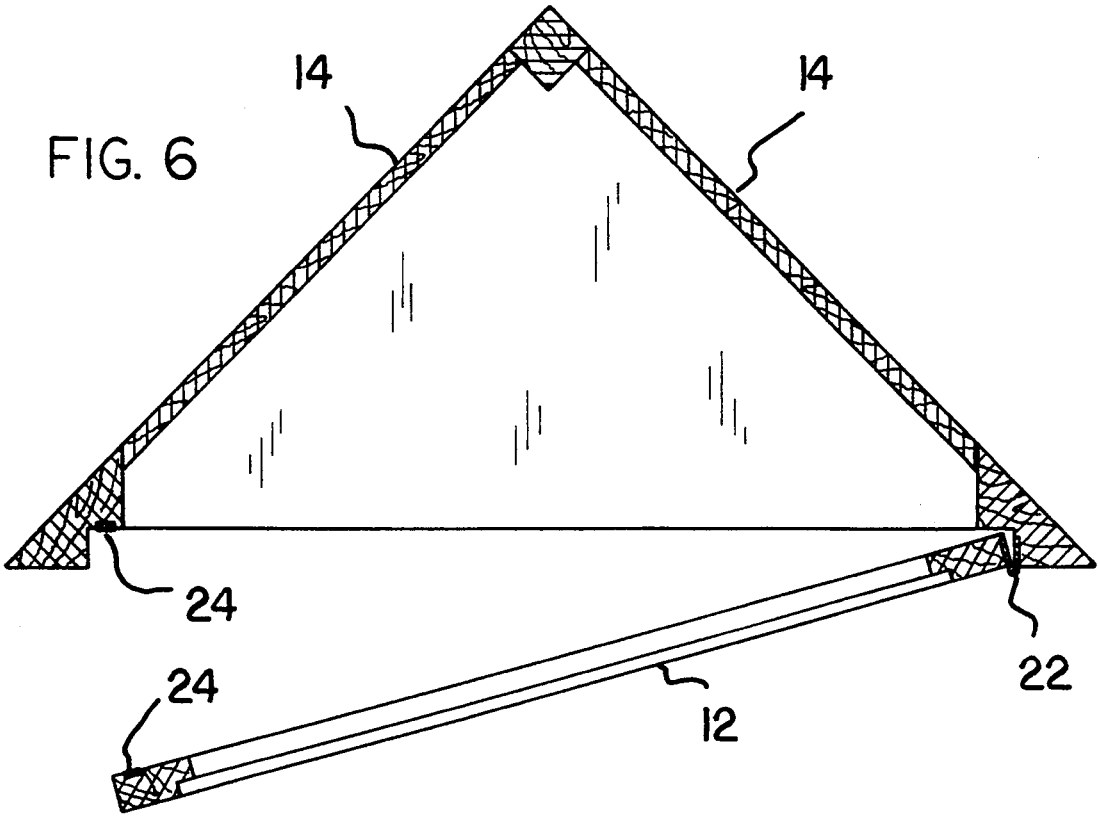

CORNER PICTURE FRAME

BACKGROUND OF THE INVENTION

1. Field of the Invention

The present invention relates to picture frames and more particularly pertains a to frame device which may be mounted in the corner formed by two intersecting walls.

2. Description of the Prior Art

The use of corner picture frames is known in the prior art. More specifically, such frames heretofore devised and utilized for the purpose of mounting in corners are known to consist basically of familiar, expected and obvious structural configurations, notwithstanding the myriad of designs encompassed by the crowded prior art which have been developed for the fulfillment of countless objectives and requirements. Typical of such frames are those illustrated in U.S. Pat. Nos. 4,727,815; 5,154,384; 4,712,761; and 5,094,421.

In this respect, the picture frame according to the present invention substantially departs from the conventional concepts and designs of the prior art, and in so doing provides an apparatus primarily developed for the purpose of ease of mounting and the possibility of multiple use of a corner picture frame.

Therefore, it can be appreciated that there exists a continuing need for new and improved picture frames which can be corner-mounted. In this regard, the present invention substantially fulfills this need.

SUMMARY OF THE INVENTION

In view of the foregoing disadvantages inherent in the known types of corner picture frames now present in the prior art, the present invention provides an improved frame construction wherein the same can be utilized for transparencies, solid pictures, and for decorative purposes as well as for storage. As such, the general purpose of the present invention, which will be described subsequently in greater detail, is to provide a new and improved corner picture frame which has all the advantages of the prior art devices and none of the disadvantages.

To attain this, the present invention essentially relates to a corner picture frame comprising an enclosed triangular compartment; a recessed hanging member at the apex of said triangular compartment; and a rectangular closure member connecting the sides of said triangular compartment and adapted to support a picture in the outer face thereof. In a preferred embodiment, the rectangular closure member is hinged to swing horizontally providing access to the interior of said triangular compartment. In such instance, at least one triangular shelf is positioned within said compartment to increase the utility of the unit. Also lights may be positioned either top or bottom or both to permit illuminating a translucent picture mounted in the closure member and additional translucent panels may be positioned as closures of the triangular box for decorative purposes.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved corner picture frame which has all the advantages of the prior art devices and none of the disadvantages.

It is another object of the present invention to provide a new and improved corner picture frame which may be easily and efficiently manufactured and marketed.

It is a further object of the present invention to provide a new and improved corner picture frame which is of a durable and reliable construction.

An even further object of the present invention is to provide a new and improved corner picture frame which is susceptible of a low cost of manufacture with regard to both materials and labor, and which accordingly is then susceptible of low prices of sale to the consuming public, thereby making such frames economically available to the buying public.

Still another object of the present invention is to provide a new and improved corner picture frame which may be used as a storage area.

Yet another object of the present invention is to provide a new and improved corner picture frame which can be illuminated to show off a transparency type picture.

Even still another object of the present invention is to provide a new and improved picture frame which can be lighted to serve as a decorative addition to a room.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front perspective view of a basic version of the present invention.

FIG. 2 is a sectional view taken on line 2—2 of FIG. 1.

FIG. 5 is a perspective view of a preferred embodiment of the present invention.

FIG. 6 is a sectional view taken vertically downward on the unit of FIG. 5.

DESCRIPTION OF THE PREFERRED EMBODIMENT

Figure 3:
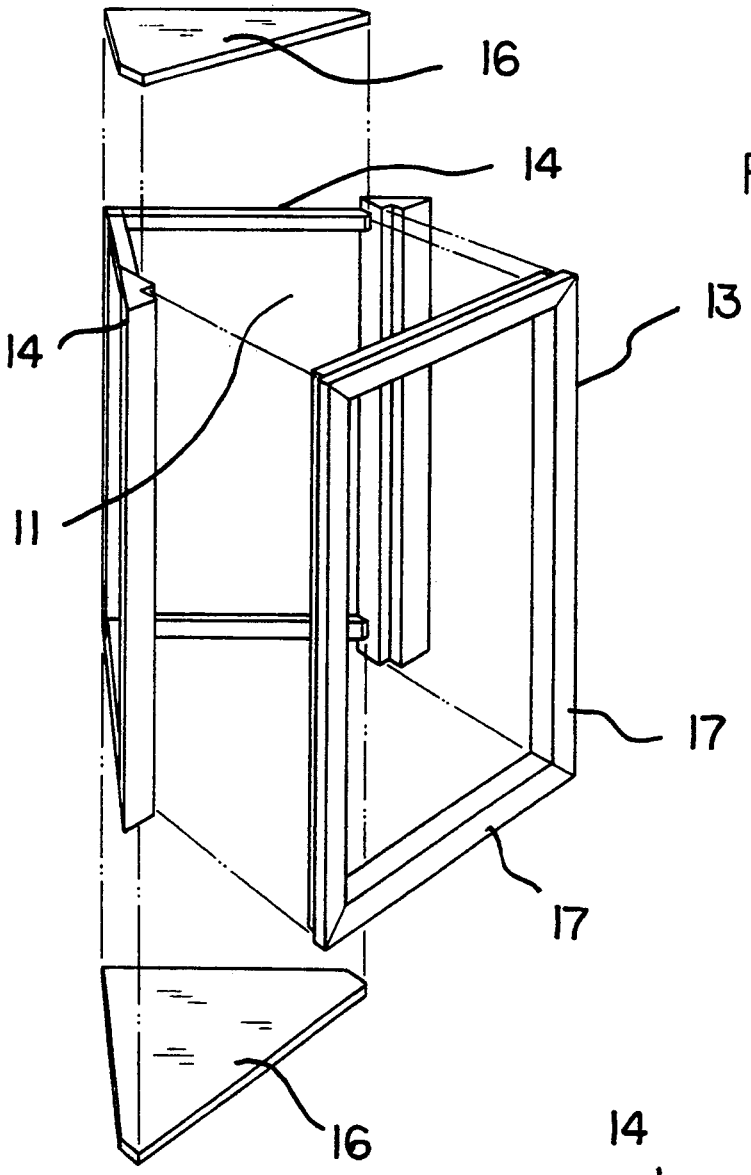
FIG. 3 is an exploded perspective view of the frame unit of FIG. 1.

With reference now to the drawings, and in particular to FIG. 1 thereof, a new and improved corner picture frame embodying the principles and concepts of the present invention and generally designated by the reference numeral 10 will be described.

More specifically, it will be noted that the device 10 of the present invention comprises a triangular compartment 11 with a picture 12 mounted on or forming a portion of an outer rectangular closure member 13 covering the outer portion of such compartment 11. As shown in FIG. 2, in its simplest form, the compartment 11 has 2 side members 14 extending at right angles to each other and an outer closure member 13 connecting the outer ends of side members 14 together. The type of fastening is not critical and may be by means of screws 15 as shown here or by adhesive or the like.

Figure 4:
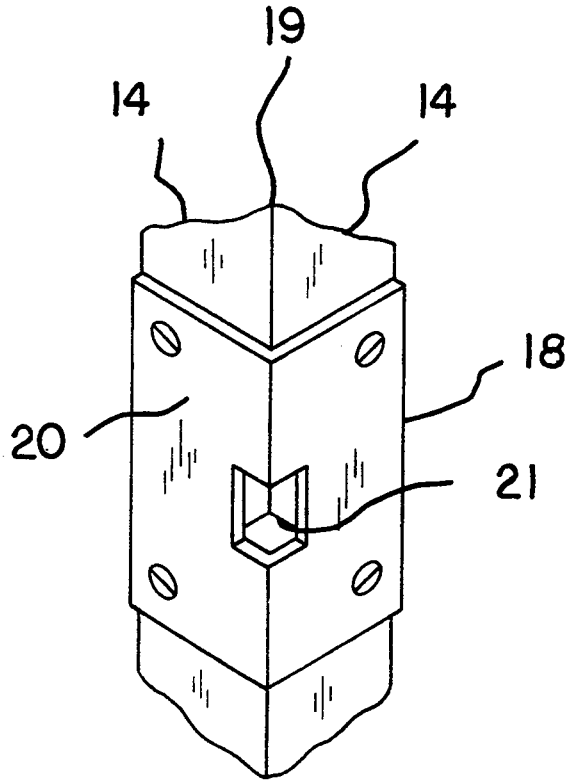
FIG. 4 is an enlarged detail perspective view of the hanger device for the frame unit.

As shown more clearly in FIG. 3, the compartment 11 is also closed at top and bottom by triangular members 16. Closure 13, while it may be solid is preferably formed by narrow rectangular members 17 fastened together to form a rectangle adapted to engage with the outer ends of members 14 and forming a frame to receive a picture 12 therein to complete the outer closure member 13. As shown in FIG. 4, a hanger 18 is positioned at the apex of the triangular compartment 11, i.e. along the junction line 19 where the side members 14 engage each other at right angles. Such hanger 18 is preferably formed by a right angle metal or plastic brace 20 having a notch 21 therein to engage with a nail or screw set into the wall juncture where the device 10 is to be hung.

FIGS. 5 and 6 illustrate a preferred modification wherein the hollow interior of compartment 11 is provided with one or more triangular shelves 23 accessed by placing hinges 22 on one side of closure member 13 and providing latch means (preferably magnetic as shown at 24 in FIG. 6).

Figure 7:
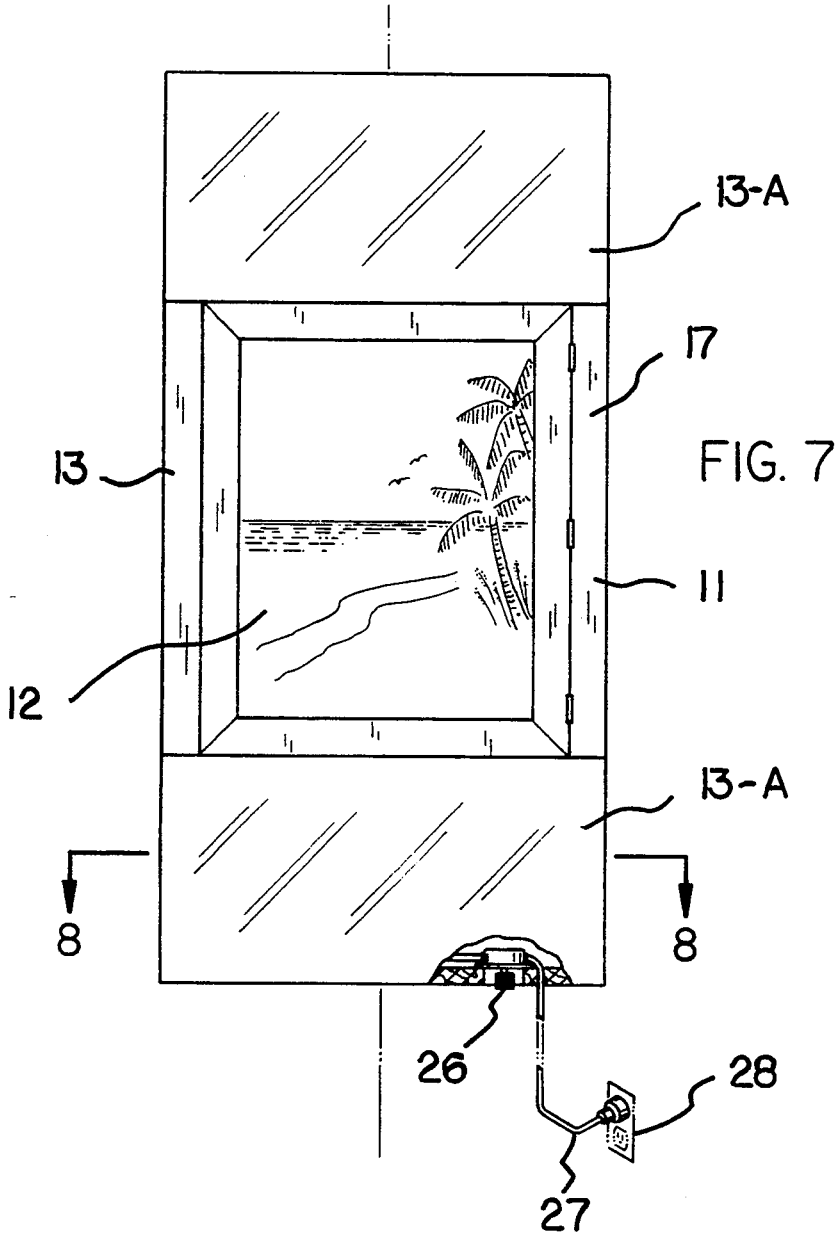
FIG. 7 is front view of a further modification of the unit of FIG. 5.
Figure 8:
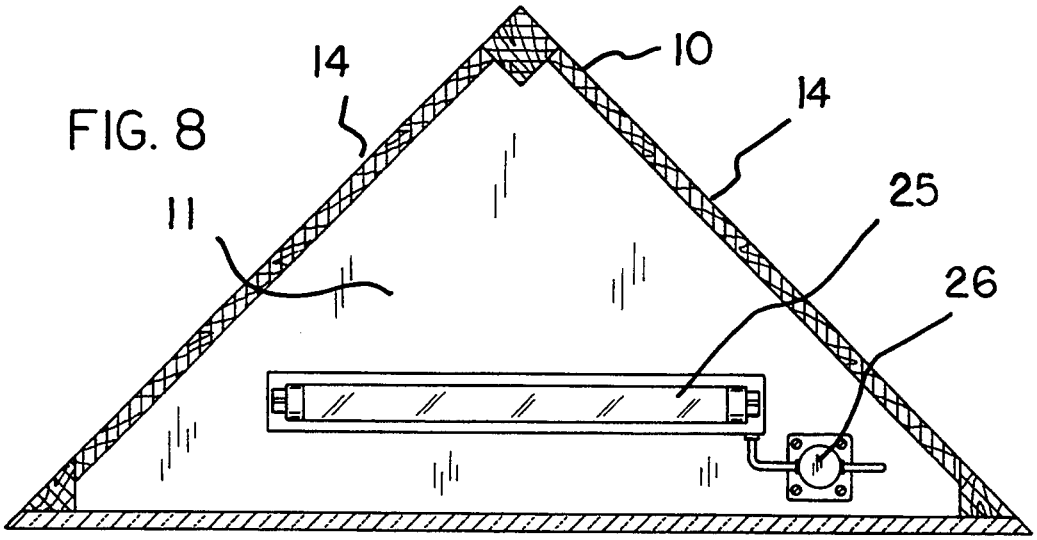
FIG. 8 is a sectional view on line 8—8 of FIG. 7.

An improvement of such modification is shown in FIGS. 7 and 8. Here, the sides 14 of the triangular compartment 11 are extended from compartment 11 either above or below (or both as shown here) and covered at their outer ends by engagement with supplemental closure members 13-A formed of a translucent plastic which may be tinted to match the color scheme of the room wherein the frame 10 is to be mounted the top and/or bottom closure 16 are secured to side members 14 at the top and bottom of such extensions, leaving the interior essentially open throughout. This permits illumination of the interior of compartment 11 by means of a light source 25 (shown in FIG. 8). Such illumination will light the translucent closure members 13-A and (if a transparency is used) picture 12. Preferably a dimmer switch 26 is utilized in conjunction with the light source 25 which is connected by a conventional wire and plug 27 to a wall socket 28 in the room where the unit 10 is mounted. Preferably, in this version, any interior shelves 23 will be of translucent or transparent materials, e.g. glass. Throughout these variations, the materials used for the triangular compartment may be formed of wood, metal or plastic as desired.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved corner picture frame which comprises: a triangular compartment formed of two solid sides coupled together at right angles to each other to form a solid side juncture, said solid sides each having an upper and a lower surface; a third side connecting said two solid sides, said third side having means to position a picture thereon; solid triangular members engaging the upper and lower surfaces of said two solid sides and enclosing said triangular compartment completely; and means at the solid side juncture of said two solid sides to accept a projection extending from a wall juncture of two intersecting walls of a room in which the picture frame is supported to mount said picture frame in the wall juncture of said room.

2. A frame as in claim 1 wherein the said third side is hingedly mounted to give access to an interior of said triangular compartment.

3. A frame as in claim 1 wherein at least one triangular shelf is positioned within said triangular compartment.

4. A frame as in claim 1 wherein said two solid sides extend beyond said third side to define outer ends and a translucent panel connects the outer ends of said two solid sides so extending, and said triangular members enclosing said compartment engage with the outer ends of said extended sides.

5. A frame as in claim 4 wherein at least one light source is positioned within said triangular compartment.

* * * * *